US007757538B2

(12) United States Patent
Mitterhofer et al.

(10) Patent No.: US 7,757,538 B2
(45) Date of Patent: Jul. 20, 2010

(54) EMBOSSING PLATE WITH A THREE-DIMENSIONAL STRUCTURE FOR THE PRODUCTION OF DOCUMENTS BY A HOT-COLD LAMINATING PRESS

(75) Inventors: Erik Mitterhofer, Vienna (AT); Markus Prancz, Vienna (AT); Maximilian Reissig, Perchtholdsdorf (AT)

(73) Assignee: Austria Card Plastikkarten und Ausweissysteme GmbH, Vienna (AT)

( * ) Notice: Subject to any disclaimer, the term of this patent is extended or adjusted under 35 U.S.C. 154(b) by 1057 days.

(21) Appl. No.: 11/213,384

(22) Filed: Aug. 26, 2005

(65) Prior Publication Data

US 2006/0191861 A1 Aug. 31, 2006

(30) Foreign Application Priority Data

Aug. 27, 2004 (DE) ..... 10 2004 041 434

(51) Int. Cl.
*B21D 17/00* (2006.01)
*B21J 13/00* (2006.01)

(52) U.S. Cl. ..... 72/469; 72/47; 72/199; 72/462; 72/700; 216/11

(58) Field of Classification Search ..... 72/53, 72/199, 47, 462, 469, 476, 700; 101/9, 29, 101/31, 32; 283/85, 91; 100/295; 156/228, 156/385, 580, 581; 264/293; 216/11; 205/70
See application file for complete search history.

(56) References Cited

U.S. PATENT DOCUMENTS 2,802,418 A * 8/1957 Carver et al. ..... 101/401.1
2,988,838 A * 6/1961 Morgan ..... 101/32
3,680,209 A * 8/1972 Hacke ..... 29/831
4,076,566 A * 2/1978 Power ..... 156/153
4,294,650 A * 10/1981 Werthmann et al. ..... 216/54
4,396,448 A * 8/1983 Ohta et al. ..... 156/219
4,765,656 A 8/1988 Becker et al. ..... 283/70
4,947,016 A 8/1990 Puyplat ..... 219/69.17
5,106,125 A 4/1992 Antes ..... 283/91
5,298,116 A * 3/1994 Werthmann et al. ..... 216/9
5,712,731 A * 1/1998 Drinkwater et al. ..... 359/619
6,043,001 A * 3/2000 Hirsh et al. ..... 430/321
6,159,659 A * 12/2000 Gelbart ..... 430/306
6,352,604 B2 * 3/2002 Droz ..... 156/196

(Continued)

FOREIGN PATENT DOCUMENTS

DE 2050285 * 5/1972

(Continued)

*Primary Examiner*—Edward Tolan
(74) *Attorney, Agent, or Firm*—Baker & Daniels LLP

(57) ABSTRACT

The invention concerns an embossing plate for a hot-cold-laminating press with a three-dimensional structure based on an essentially flawless metal plate with a hardened surface of appropriate thickness and dimensions and a suitable surface, specifically a highly polished surface, into which or onto which the three-dimensional structure is incorporated by a process with at least two steps.

An embossing plate produced by this process is used for the production of documents, specifically security documents, such as personal identity cards, passports, identification cards, credit cards, customer cards, driving licenses and similar sheet and/or card and/or book-like documents by means of hot-cold-lamination and/or embossing and/or item-by-item embossing.

17 Claims, 3 Drawing Sheets

U.S. PATENT DOCUMENTS

| | | | | |
|---|---|---|---|---|
| 6,749,925 | B2 | 6/2004 | Hoppe et al. | 428/167 |
| 6,950,140 | B2 * | 9/2005 | Fukuyoshi et al. | 348/340 |
| 7,108,819 | B2 * | 9/2006 | Harker et al. | 264/219 |
| 7,134,205 | B2 * | 11/2006 | Bruennel | 29/896.5 |
| 2002/0038789 | A1 | 4/2002 | Grear | |
| 2004/0217177 | A1 | 11/2004 | Hoppe et al. | |
| 2005/0072326 | A1 | 4/2005 | Braun et al. | 101/170 |

FOREIGN PATENT DOCUMENTS

| | | |
|---|---|---|
| DE | 197 41 998 | 3/1999 |
| DE | 102 01 032 | 7/2003 |
| EP | 0 172 947 | 3/1986 |
| EP | 0 216 947 | 4/1987 |
| EP | 0 322 301 | 6/1989 |
| EP | 0 219 012 | 1/1993 |
| EP | 0 790 898 | 5/1996 |
| EP | 0 842 791 | 5/1998 |
| EP | 0 843 281 | 5/1998 |
| GB | 401579 | 11/1933 |
| WO | WO 97/19816 | 6/1997 |
| WO | WO 00/00921 | 1/2000 |
| WO | WO 03/057494 | 7/2003 |
| WO | WO 03/103962 | 12/2003 |

* cited by examiner

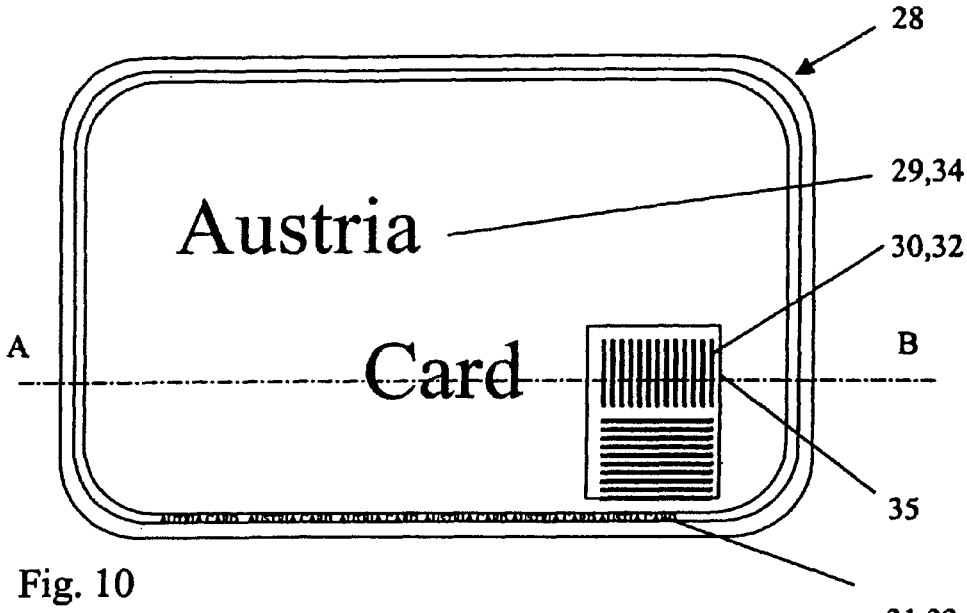
Fig. 10
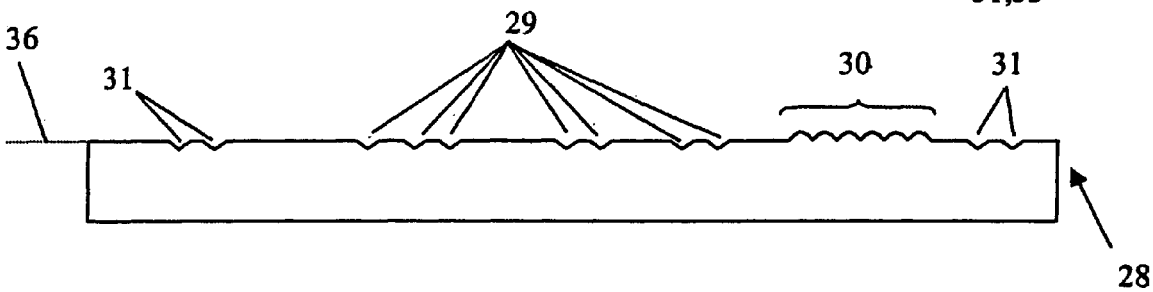
Fig. 11 Section A-B
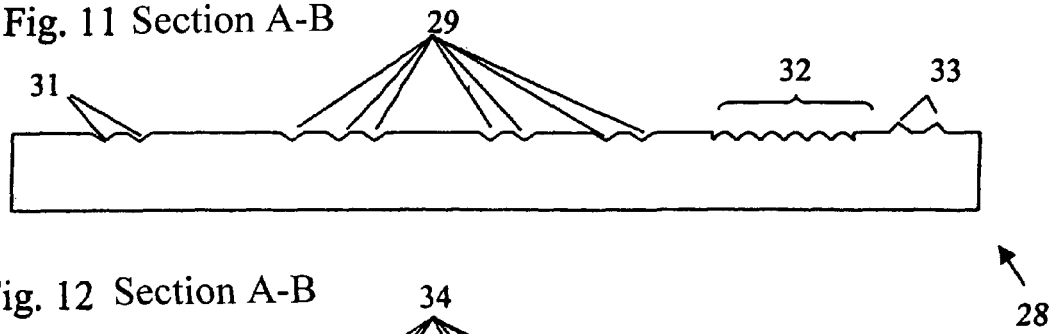
Fig. 12 Section A-B
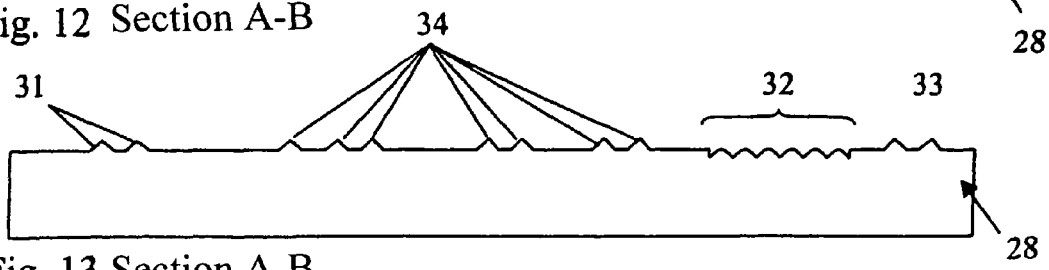
Fig. 13 Section A-B

EMBOSSING PLATE WITH A THREE-DIMENSIONAL STRUCTURE FOR THE PRODUCTION OF DOCUMENTS BY A HOT-COLD LAMINATING PRESS

The object of the invention is an embossing plate for a hot-cold-laminating press with a three-dimensional structure, the production of such an embossing plate, and the application in the production of documents, specifically security documents, such as personal identity cards, passports, identification cards, credit cards, customer cards, driving licenses and similar sheet and/or card and/or book-like documents by means of thermal transfer press lamination.

The present invention enables the economical production of an individual three-dimensional embossing plate for the production of surface-embossed documents by means of lamination and/or embossing and/or item-by-item embossing in a hot-cold-lamination press.

DESCRIPTION OF THE STATE OF THE ART

EP 0 216 947 B1 (Maurer Electronics) and EP 0 219 012 B1 (GAO) and the descriptions of EP 0 842 791 B1 (Giesecke & Devrient), EP 0 790 898 B1 (Giesecke & Devrient), and EP 0 843 281 A2 (Giesecke & Devrient) describe data carriers with an optical characteristic of genuineness and processes to produce and check the data carrier on the basis of lenticular raster elements. Information is input here by a laser beam to generate a hologram that will present different visual information at two different angles of view.

The known production methods use classical transfer lamination with multiple repeats and subsequent surface embossing into a finished document by various methods.

The documentations for DE 102 01 032 A1, Braun Eckhard (Giesecke & Devrient GmbH, 81677 München, Germany; "Steel Engraving Printing for the Production of a Security Document as well as Steel Plates and Intermediate Products for the Same and Methods of their Production."), WO 97/19816 A1 (Scheppers Druckformtechnik GmbH; Sauer-essig GmbH & Co.), WO 00/00921 A1 (Mazumder), WO 03/103962 A1 (KBA-Giori S.A.), EP 0 322 301 B1 (Banque de France) and WO 03/057494 A1 (Giesecke & Devrient GmbH) describe methods, processes and equipment for the production of printing plates, specifically steel engraving plates, for use in the printing of security documents, specifically of currency notes.

All of these processes and machines specify printing plates or plates for printing applications; however, there is no mention of a solution for use in a hot-cold-laminating press. GB 401 579 publishes an improved embossing plate made of aluminum or an aluminum alloy, such as engraving plates, consisting of a hard, wear-resistant, and attached oxide film or that has a surface consisting essentially of aluminum oxides. This invention has the disadvantage that the printing plate is claimed merely as equipment, but not its use or application.

U.S. Pat. No. 5,106,125 A publishes a system to improve the protection against forgery of a security document, where a foil is attached locally to the surface of the security document, where the foil has at least one security characteristic, where the security characteristic has a microstructure for refracting light incidence and a security profile in the form of a macro structure embossed into the surface of the security document, where the security characteristic and the security profile are partially superimposed such that the relief lines of the macro structure of the security profile bulge above the plane of the surface of the security document and exhibit sufficiently recognizable shimmer effects of light incidence, where the use of this arrangement creates one or more predetermined breaks in the security characteristic, if the security characteristic is removed from the security document and is deformed in such a way that the deformation is easily seen, if the security document is applied to a second security document. This invention has the disadvantage that the security profile is embossed into the surface of the security document.

There is need of the use of a highly polished embossed surface and the production of three-dimensional depressions and the production of raised microstructures and this without damage to the polished surface. The recessed structures generated in the embossing plate will be raised in the laminated or surface-embossed document and the structures raised in the embossing plate will be recessed in the laminated or surface-embossed document.

THE OBJECTIVE OF THE INVENTION

The present invention has the objective of economical production of a structured embossing plate for use in a lamination press for the production of laminated cards or identity cards, for example, and similar documents.

THE SOLUTION OF THE OBJECTIVE

The problem in the solution of the objective of the invention was to incorporate three-dimensional structures into a highly polished embossing plate without damaging the highly polished surface. The reference surface is defined here as a highly polished surface that may not be damaged in any case by the structures described below.

The invention proposes an embossing plate for a hot-cold-laminating press with a three-dimensional structure on a largely flawless metal plate with a hard surface of suitable thickness and dimensions and with a suitable surface, specifically a highly polished surface.

The first embodiment of the invention assumes that the recessed structure (which preferably has an optical effect) is incorporated in a single step into the embossing plate as a three-dimensional structure. The methods to generate such a structure are described in detail in the following. Each of the methods described there is intended to be suitable to generate the desired three-dimensional recessed structure by itself or in combination.

However, the invention is not restricted to the production of the three-dimensional recessed structure in a single processing step. The following discussion also presents processes with two and more steps.

If the three-dimensional structure produced in the first processing step is to be processed further, a second processing step is added that realizes the desired additional structuring of the previously produced three-dimensional structure.

Likewise, a two-step process is used, if the recessed structures of the first processing step are applied to an enlarged processing area, where untouched areas remain within this enlarged processing area (such as the margins), where the second processing step adds a different recessed or raised structure (such as micro-type) to the untouched areas.

However, the production of recessed and raised structures requires at least two processing steps.

This structure is incorporated into the highly polished surface of the embossing plate by a process with at least two steps.

The phrase "process with at least two steps" means that the structure is incorporated with at least two different processing steps. It remains an open question whether these two processing steps are sequential or concurrent. Of course, it is also possible to use more than two processing steps.

For example, the first processing step applies a full coverage of a photo mask by means of lamination, spray, printing, roller application, flood application and other application methods and uses a suitable exposure by way of mask exposure and/or laser exposure.

Then those structures are uncovered (stripped) that are to be processed by a subsequent chemical and/or galvanic ablative process. This method produces three-dimensional recessed structures.

Depending on the nature of the chemical or galvanic bath, the undercut of the masked structures can be controlled to generate essentially half-round recessed structures, which will generate lens-like raised structures in use as an embossing plate.

The second processing step applies a second photo mask on the entire surface, with particular care that the previously produced three-dimensional depressions are covered completely. After a second exposure and uncovering of the second or subsequent structure to create a raised microstructure on the embossing plate, a second chemical or galvanic process is used to produce a raised microstructure.

As an alternative to this second photo masking and galvanic process, an additive laser treatment process may be used to produce the raised structure or a subtracting or ablative laser process may be used to produce the recessed structure.

Another embodiment of the invention may use a galvanic plate in lieu of a metal plate with a highly polished or matt surface. This variation produces a structure for multiple repeats once and uses it to produce the galvanic plates. These galvanic plates are then subjected to further structuring processes.

The advantage of this variation is that, for example, the critical lens-shaped structures may be incorporated already in the first step and that the number of galvanic plate required for the production run can be produced and that these galvanic plates then will require only require only relatively simple micro-structuring processes, but will not require the extensive lens structuring processes. An additional advantage of this variation is that it makes high-quality embossing plates available for subsequent micro-structuring processes.

The embossing plate produced in this manner will be used to produce documents, specifically security documents, such as personal identity cards, passports, identification cards, credit cards, customer cards, driving licenses and similar sheet and/or card and/or book-like documents by means of lamination and/or embossing and/or item-by-item embossing in a hot-cold-lamination press.

This normally uses transfer press systems. In this process, several printed and non-printed sheets that are positioned to match each other (overlay sheets and core sheets) are laminated to each other or are connected to each other in a hot press at typically 200 to 300 N/cm$^2$ and the required lamination temperature of more than 100° C. to roughly 200° C. and subsequently in a cold press at typically 200 to 550 N/cm$^2$ and a cooling temperature of normally less than 50° C., however preferably less than 25° C.

The normal transfer press system usually uses several levels with cassettes, and several plates and laminating packets are stacked in the cassettes. Equalizers of fiberglass-reinforced rubber mats or paper or felt-like spacers are often used between the cassettes or the plates. These deformable spacers are intended to increase or improve the uniform area pressure or to equalize irregularities.

Normally specialized stainless steel plates with a highly polished or satin or matt structure are used as printing plates in a multiple-level press known from the state of the arts. Normally, these printing plates may be used on both sides. In addition to the multiple-level press, round-table presses or single press units are often used.

Plates with thicknesses between 0.3 and 2.0 mm are used, preferably with thicknesses between 0.8 mm and 1.5 mm. The format to be used will be chosen from single use to multiple repeats of typically 20 or 24 or 48 repeats for laminate elements of credit card size. A typical plate is produced, for example, by Böhler Bleche GmbH in A-8680 Mürzzuschlag/Austria with the type designation A-505 in steel quality level DIN 1.4301 or AISI 302.

Plates with lens structure, usually in the form of raised or recessed lenticular lens systems, are used to produce documents with surface lens structure elements. This may use galvanically produced plates of galvanotype nickel or steel or nickel plates with lens inserts. Care must be taken in all cases to use plate pairs with similar coefficients of thermal expansion.

A plate is defined as a metallic plate with a thickness between 0.3 and 2.0 mm, preferably with thicknesses between 0.8 mm and 1.5 mm. The usual format to be used will be chosen from single use to multiple repeats of typically 20 or 24 or 48 repeats for laminate elements of credit card size. A typical plate is produced, for example, by Böhler Bleche GmbH in A-8680 Mürzzuschlag/Austria with the type designation A-505 in steel quality level DIN 1.4301 or AISI 302. Alternatively, galvanically clad steel plates or galvanically constructed plates, such as nickel plates, may be used.

Only plate pairs of the closest comparable coefficient of thermal expansion must be used in all cases. A high degree of surface hardness is an advantage for long idle periods. The surface is preferably highly polished. Satin or matt surfaces may be used for specific applications. Double-sided plates are normally used in a level press with cassettes, where the first and last plate is used with only a single side towards the laminate packet.

If structured plates or embossing plates are used, the possibility of double-sided use is also of advantage, but it encounters technical and economic limits. This requires an comparison of the required production run or planned series and the required delivery deadline against the added costs in the production of double-sided structured embossing plates.

A document is defined in particular as security documents, such as personal identity cards, passports, identification cards, credit cards, customer cards, driving licenses and similar sheet and/or card and/or book-like documents. Here at least the top laminate item must be thermoplastically deformable under the normal surface press power up to 500 N/cm$^2$ and often at higher power levels up to about 650 N/m$^2$. A vacuum-assisted lamination press may be advantageous for critical embossing. It would absolutely preclude air pockets.

A lens structure is defined as a three-dimensional and optically largely transparent body that is present or is produced in or on the surface of the document raised and/or recessed by means of embossing plates.

The normal embodiment uses lenticular lens systems, where lens series with varying radius and varying raster dimensions may be used. This results from the varying embossing height or embossing depth over the embossed area.

A simplified embodiment uses lens-like pockets in the embossing plate, which generate raised lens-like structures on the document.

Another embodiment generates first a raised area on the embossing plate, into which the lens-like structure is incorporated, and then uses it to produce a document, where the lens-like structure is situated below the (preferably highly polished) surface.

Apart from linear lens-like structures, hexagonal or triangular or dotted lens-like structures may be used just as well. The nature of the lens is often not critical, depending on the use, and relatively large deviations from a radius may be accepted or desirable. The three-dimensional optical structures may also be rectangular, parabolic, elliptical, trapeze-like, V-shaped or irregularly shaped and/or in a composite shape.

Such three-dimensional optical structures are intended to so influence the light rays for visual and/or machine viewing of information contained within, i.e. in the interior of the document, that there is a change in the visual or machine viewing perception of this information. As the viewing angle changes, so changes the selected information.

If positively bent optical structures are used, there is also an optical enlargement of an element of the underlying information, whereas the optical view in level optical structures depends on the angle relationships.

Undercut is defined as the production of a photo mask, where the openings are so small that there is an essentially isotropic etching, given an appropriate etching bath, thus creating a strong undercut. This may achieve the same lateral etching effect as in the vertical dimension, thus generating the desired lens-like depressions. The prerequisite for such an etching process is a suitable photo masking, suitable etching bath and flawless plates or flawless surfaces. Such an etching suffices as a single processing step to generate a three-dimensional structure recessed under the reference level in the material of the embossing plate.

Microprint is defined as a structure that cannot be read with the naked eye. The letters may be raised or recessed and may otherwise be linear or dotted.

A diffractive structure is defined as a light-bending optical area or line-shaped or graphically designed element that is embossed in the surface by the embossing plate. In a preferable embodiment, the diffractive element is slightly recessed and is thus protected from mechanical damage, such as scratches and rubbing.

Lamination is defined, for example, as treatment in a transfer press system, a round table press, a feed-through press or a single packet lamination unit. In this process, several printed and non-printed sheets (overlay sheets and core sheets) that are positioned to match each other are laminated to each other or are connected to each other in a hot press at typically 200 to 300 N/cm$^2$ and the required lamination temperature of more than 100° C. to roughly 200° C. and subsequently in a cold press at typically 200 to 550-N/cm$^2$ and a cooling temperature of normally less than 50° C., however preferably less than 25° C.

However, it is also feasible that individual lamination packets can be laminated in subsequent heat press and cold press processes, and the lamination process may also be done in a lamination press, where the heating process and the cooling process are done sequentially in the same press. Small laboratory units or experimental units often use this approach.

A vacuum-assisted lamination press may be advantageous in a specialized variation of lamination, where it would absolutely preclude air pockets for uneven layers to be laminated.

Surface embossing and/or individual surface embossing is defined as the addition of a surface structure to essentially completed document. Given that there is at least one thermoplastic top layer, the embossing plate must be pressed onto the document surface with a suitable press, while appropriately heated, and the embossing plate must then be cooled under pressure. This process requires relatively long processing periods. Ultrasound treatment and/or microwaves may often yield sufficiently good embossing results with substantially shorter processing times.

BRIEF DESCRIPTION OF THE DRAWINGS

Some examples of the invention are described in more detail in the following by reference to figures.

They show:

FIG. 10: a representative depiction of a document (28) with lettering (29, 34), a lens raster element (30, 32), a diffractive element (35) and micro print (31, 33), FIG. 11: a schematic depiction of a cross section of the document example (28) with recessed structures (29, 31, 35) and raised structures (30), FIG. 12: a schematic depiction of a cross section of the document example (28) with recessed structures (29, 31, 35, 30), FIG. 13: a schematic depiction of a cross section of the document example (28) with recessed structures (32, 35) and raised structures (33, 34).

DETAILED DESCRIPTION

Figure 1:
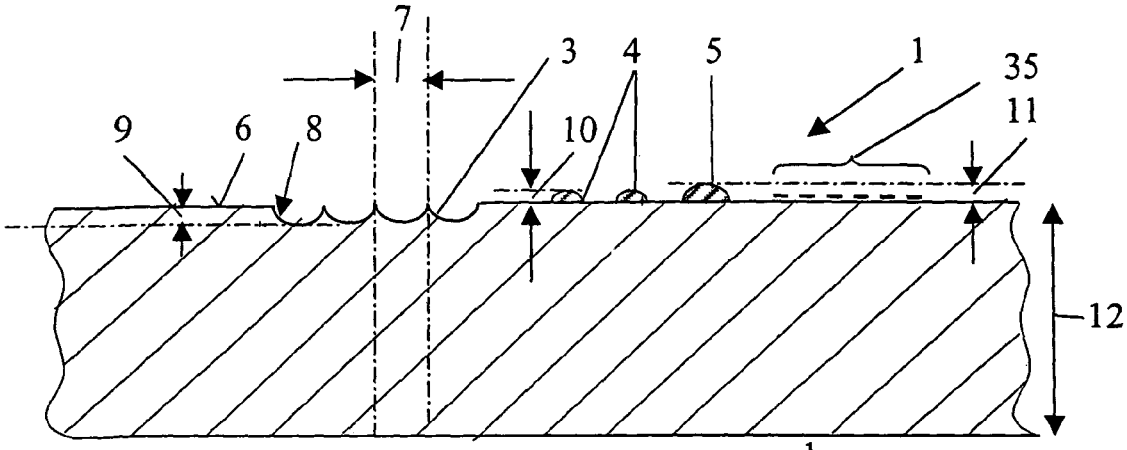
FIG. 1: a schematic drawing of a cross section of embossing plate (1) with a recessed lens structure (3), raised structures 1 and 2 (4, 5) and a diffractive structure (35)

FIG. 1 presents a schematic drawing of a cross section of embossing plate (1) with a recessed lens structure (3), raised structures 1 and 2 (4, 5) and a diffractive structure (35).

Embossing plate (2) may consist here of steel, preferably stainless steel, and must have an essentially flawless and non-pitted surface. However, it is also feasible to use a less rust-resistant steel with a galvanic surface layer, such as nickel. Or a sheet produced by galvanic means, such as from nickel, may be used.

Normally such layers or sheets produced by such galvanic means have a good flawless material composition, which enables the incorporation of smallest and three-dimensional structures (3, 7, 8, 9) and also a good adherence with elements (4, 5) applied by chemical or galvanic means.

This figure depicts an example of an embossing plate (1) with a recessed and lens-like structure (3, 7, 8, 9), where this recessed structure (3, 7, 8, 9) generates a raised and protruding structure (30, 32)—see FIGS. 10 to 13—on the upper surface of document (26).

The normal radius (8) is specified as 70 to 150 μm, specifically in the vicinity of 90 μm, with a typical depth (9) of 50 to 120 μm, specifically in the vicinity of 70 μm, and a raster size (7) of 100 to 300 μm, specifically 170 μm.

The incorporation of such lens raster elements (3) generates holograms of printed elements in the interior of document (28).

The raised structures (4, 5) are additive structures on the surface of embossing plate (2) and are shown in examples with two differing heights. Width and height (10, 11) are selectable in wide ranges. Structures (4, 5) may be embodied here as points, lines or areas.

The production of these recessed and raised structures on both sides of the (highly polished) reference surface (6) is normally done by a two-step structuring process.

The first step of the structuring process is a photo masking of the embossing plate surface (6). A subsequent exposure step with a mask or a direct exposure system follows. The photo mask is then removed from the exposed or unexposed areas with appropriate stripping fluids, depending on the type of the photo mask.

An appropriate etching control then uses an etching solution to generate a semi-circular (3) or grooved (13) or V-shaped (15) or U-shaped recess in the uncovered structures. It is normally feasible also to recess a larger area (22) without an undercut.

However, the first step of the structuring process may also be handled by galvanic action, and either recessed or raised structures are generated above or below the level of reference surface (6). Such galvanic action is usually done on a nickel base, and in the present case the thickness of the galvanic layer for use in an embossing plate must be produced in a hot-cold-laminating press.

The second step of the structuring process may now be handled by photochemical or photo-galvanic and/or laser action.

Here the structured surface resulting from the first structuring process is covered by a photo mask, exposed, developed and stripped, thus generating a second structure or additional structures by etching and/or galvanic action.

The difficulty here is that the structures resulting from the first structuring process must be covered well, or protected, which may be done by lamination with a photosensitive film. Such lamination is usually handled by vacuum lamination and/or by wet lamination. However, it may also be handled by a flood process or by spray layering.

However, at least the second structuring process may also be handled by a laser process. Recesses may be generated by laser ablation and raised points by melting of appropriate surface-applied materials.

Laser ablation may also produce fine guilloche-like structures or microstructures. The kind of recess may be controlled here as steps or as spirals by an appropriate impulse control.

The laser deposition structure may be accomplished by application or lamination or spray application or printing application of suitable materials. The laser beam is led here with appropriate output and impulse length or impulse frequency and suitable focus in accordance with the intended graphical design of the surface. The unused material is then removed.

The diffractive structure (35) is embodied in this embodiment variation essentially level with the surface of the embossing plate (6) and is produced by micro precision etching and/or by ablative laser action.

The embossing plate surface (6) in the preferred variation is highly polished and will not be deformed by the various photo masking or structural production processes.

Figure 2:
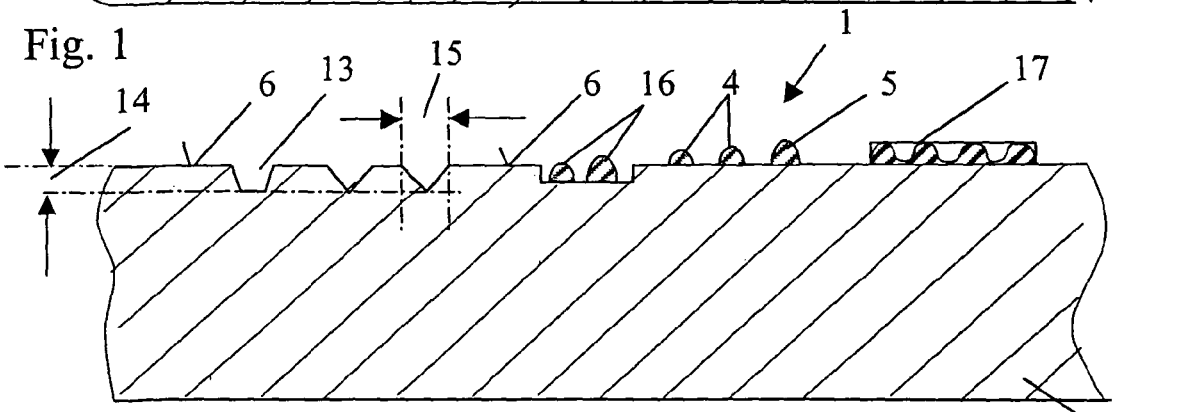
FIG. 2: a schematic drawing of a cross section of embossing plate (1) with a recessed grooved structure (13), a V-shaped depression (15), with raised structures 1 and 2 in a depression (16), with raised structures (4, 5, 17)

FIG. 2 presents a schematic drawing of a cross section of embossing plate (1) with a recessed grooved structure (13), a V-shaped depression (15), with raised structures 1 and 2 in a depression (16), with raised structures (4, 5, 17).

In addition to these grooved (13) and V-shaped (15) recesses with a depth (14) ranging from a few μm to some 50 μm to no more than 100 μm, many other forms may be designed, where the photo masking and etching process or the galvanizing process must be adjusted accordingly.

The raised structure in recess (16) is generated by a multi-step process. The cavity must be produced in a first photo masking process and a first material removal process, and the two raised structures (16) must be generated in a subsequent additive process.

In addition to the creation of raised structures (4, 5), negative structures may also be generated. To that end, first the raised area structure is produced and subsequently the recesses (17) are generated. The resulting structures on document (28) are naturally recessed (29).

Figure 3:
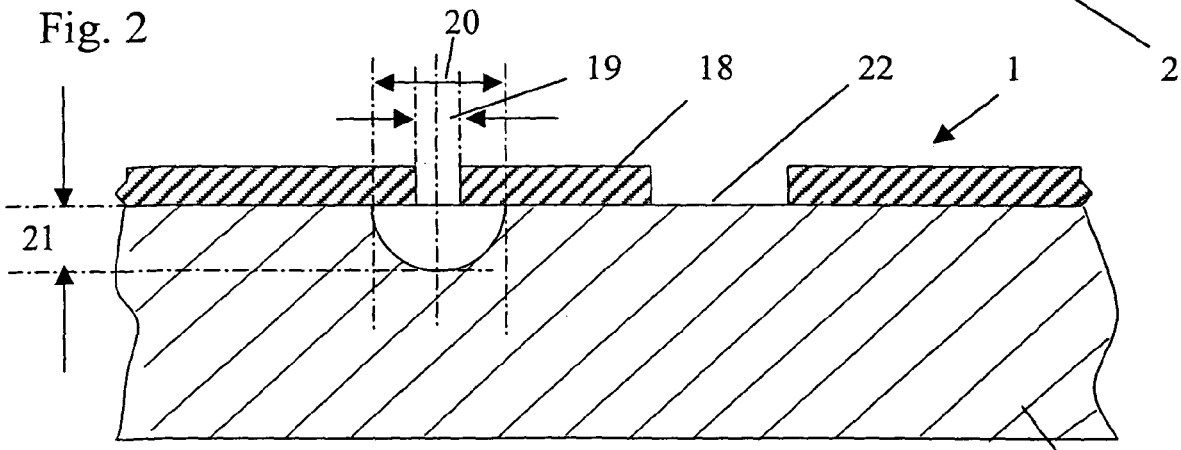
FIG. 3: a schematic drawing of a cross section of embossing plate (1) with photo masking (18) to produce lens-like undercuts (19, 20, 21)

FIG. 3 shows a schematic drawing of a cross section of embossing plate (1) with photo masking (18) to produce lens-like etch patterns (19, 20, 21).

This FIG. 3 depicts schematically the principle of the undercut (19, 20, 21), where the semi-circular undercut is only one example of a possible form. Normally, an isotropic etching speed may be assumed for an appropriate solution. Thus, the depth of the lateral etching in the immediate vicinity will be roughly equal to the general depth.

Point-shaped or line-shaped lens-like recessed structures may be produced in this manner.

In that process, the photo mask (18) plays a very significant role, since it must remain in place throughout the time period of the entire chemical or galvanic process and must remain in good contact with the surface of embossing plate (2). Subsequently, it must be removable (strippable) without difficulty.

The vertical etching without undercut (22) shows that removal without undercut is feasible for appropriate solutions. Generally, removal with and without undercut is handled in different processes.

Figure 4:
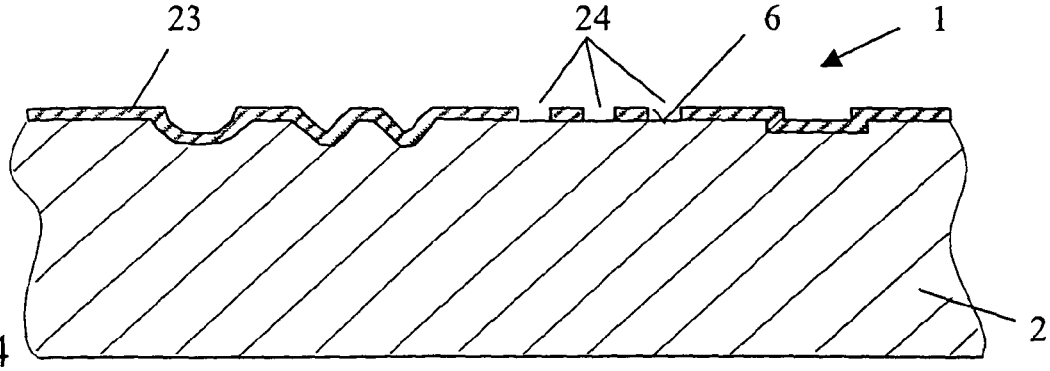
FIG. 4: a schematic drawing of a cross section of embossing plate (1) with a second photo masking (23) to produce a second surface structure (24)

FIG. 4 shows a schematic drawing of a cross section of embossing plate (1) with a second photo masking (23) to produce a second surface structure (24). This figure will be used to illustrate the problem of masking for a surface with a previously produced structure.

If films are used as photo masks (23) with a photo-polymer layer thickness of typically 25 μm or 50 μm or 75 μm, polyester foils are used in addition, which often preclude lamination of the recessed structures without air pockets. Even though the state of the arts includes wet lamination foil systems and vacuum lamination systems, such systems and processes are cumbersome and expensive. Spraying or squeegee or screen-printing or flood or roller application are often simpler and more efficient processes for confirmed lamination. Openings (24) for the second surface structuring are produced by any process.

Figure 5:
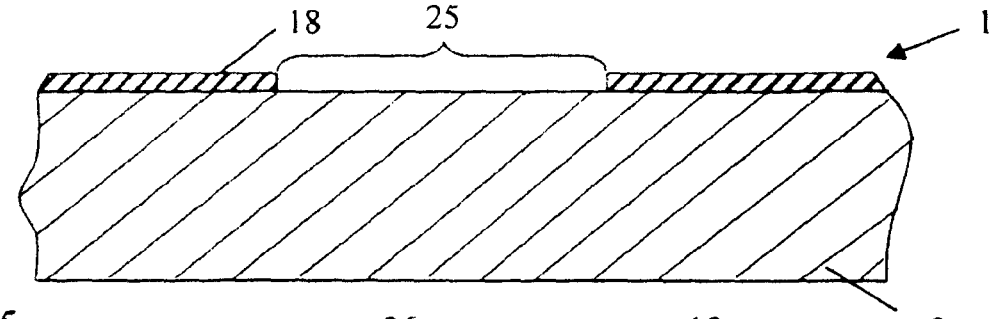
FIG. 5: a schematic drawing of a cross section of embossing plate (1) with a photo masking (18) to produce a surface structure (25)

FIG. 5 shows a schematic drawing of a cross section of embossing plate (1) with a photo masking (18) to produce a surface structure (25). This step in the production of structure on an embossing plate (2) serves to uncover an area structure (25) for a galvanic plate (26).

Figure 6:
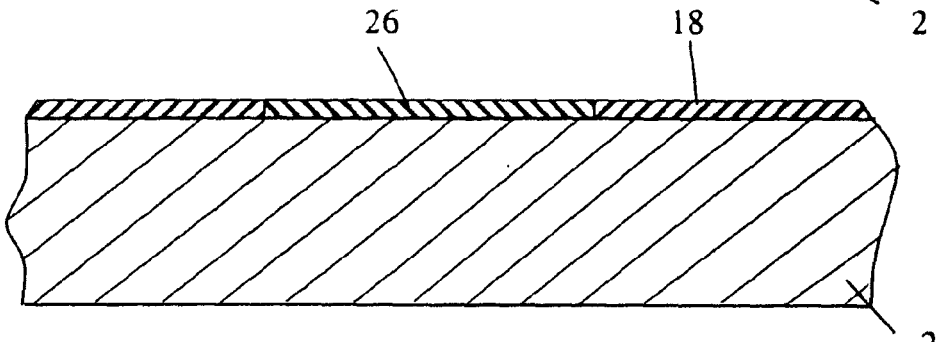
FIG. 6: a schematic drawing of a cross section of embossing plate (1) with a photo masking (18) to produce a galvanic plate (26)

FIG. 6 shows a schematic drawing of a cross section of embossing plate (1) with a photo masking (18) to produce a galvanic plate (26). This galvanic plate (26) must adhere closely to the surface of embossing plate (2), must be as flawless as possible, and should have a similar thermal expansion coefficient as embossing plate (2).

Nickel is used as the preferred galvanic material, as it has a sufficient surface hardness on one hand and a good consistency for laminating or embossing processes on the other hand.

Figure 7:
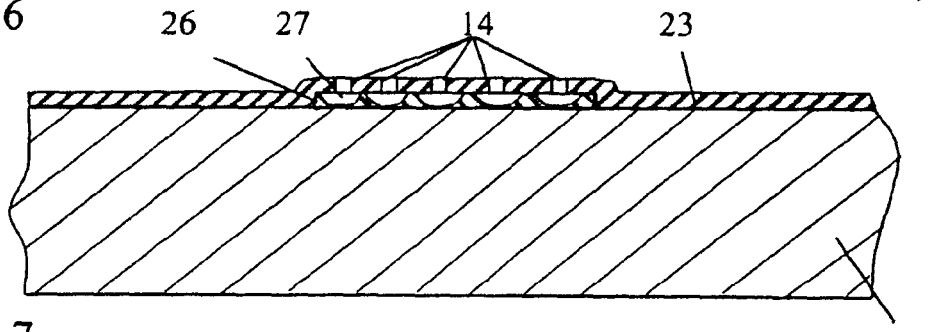
FIG. 7: a schematic drawing of a cross section of embossing plate (1) with a second photo masking (23) to produce a recessed lens structure with an undercut (27)

FIG. 7 shows a schematic drawing of a cross section of embossing plate (1) with a second photo masking (23) to produce a recessed lens structure with an undercut (27). The mask openings (24) must be aligned precisely with the desired undercut form (27).

Figure 8:
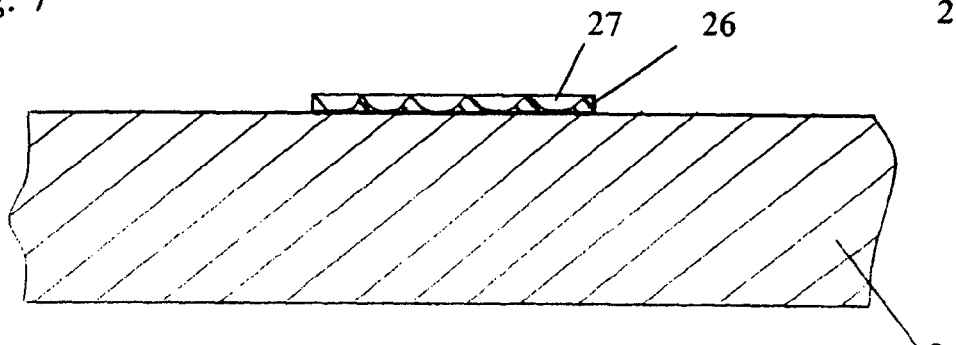
FIG. 8: a schematic drawing of a cross section of embossing plate (1) with a recessed lens structure with an undercut (27)

FIG. 8 shows a schematic drawing of a cross section of embossing plate (1) with a galvanic plate (26) with recessed lens structure with an undercut (27). Such a lens structure (27) facilitates the production of a recessed lens structure (32) on a document (28).

Figure 9:
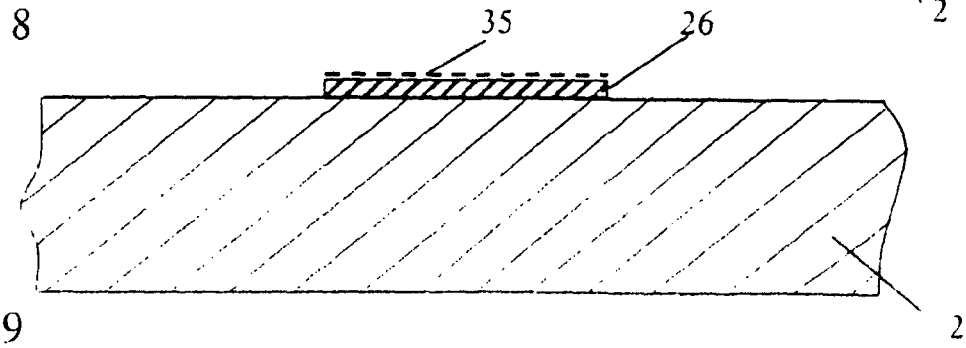
FIG. 9: a schematic drawing of a cross section of embossing plate (1) with a galvanic plate (26) and a superimposed diffractive structure (35)

FIG. 9 shows a schematic drawing of a cross section of embossing plate (1) with a galvanic plate (26) and a superimposed diffractive structure (35). Such a diffractive structure (35) facilitates the production of a recessed diffractive structure (35) on a document (28).

FIG. 10 shows a representative depiction of a document (28) with lettering (29, 34), where the letters "Austria Card" are added by means of an embossing plate, which, for example, uses photo masking with a subsequent chemical or galvanic ablative process to generate recessed structures or forms a raised microstructure in a subsequent second processing step after a second exposure and uncovering with a subsequent chemical or galvanic process.

The lens raster element (30, 32) shown here likewise has raised and/or recessed structures, which are produced by the actions of lens-like recesses in the embossing plate or by a lens-like structure on a raised area on the embossing plate, where the lens structures are formed with varying radius and different raster measurements, which derive from the varying height or depth of the embossing.

A diffractive element (35) is included as a light-bending optical, area or line-shaped or graphical element, which is preferably situated slightly recessed in order to protect it from mechanical damage and which has a horizontal, vertical or arch structure. An element with a diffractive structure may be embodied in an element with a lens raster structure.

The depicted micro print element (31, 33) has a structure that cannot be read with the naked eye and that is likewise raised and/or recessed, where the structure is in line or point form.

The raised or recessed structures are normally referenced to the reference plane (36), which forms the surface of the document without any added raised or recessed areas.

Document (28) is normally produced by a transfer press system known from the state of the arts.

FIG. 11 shows a schematic depiction of a cross section A-B of the document example (28) with recessed structures (29, 31, 35) and raised structures (30). This depiction shows clearly that lens raster element (30, 32) is embodied as a raised structure and that micro print (31) is embodied as a recessed structure.

FIG. 12 shows a schematic depiction of a cross section A-B of the document example (28) with recessed structures (29, 31, 35, 30), where the specified structures (31, 29, 32) are embodied in the depicted embodiment of a document (28) as recesses and where the micro print structure (33) is embodied in addition as a raised structure.

FIG. 13 shows a schematic depiction of a cross section A-B of the document example (28) with recessed structures (32, 35) and raised structures (33, 34), where the determination of the recessed or raised structures is partially the reverse of FIGS. 10 to 12 and where it is determined as a function of the use of document (28), where the micro print (31, 33) within document (28) may have a raised or a recessed structure.

REFERENCE IDENTIFICATION LISTING

1 Embossing plate (press plate) with three-dimensional structure
2 Embossing plate (press plate)
3 Recessed lens structure (in the embossing plate)
4 Raised structure 1 (on the embossing plate)
5 Raised structure 2 (on the embossing plate)
6 Highly polished surface (=reference surface; optional: satin or matt)
7 scale of the lens system
8 Radius of the lens system
9 Depth of the lens system
10 Height of raised structure 1
11 Height of raised structure 2
12 Thickness of the embossing plate
13 Recessed structure, grooved
14 Depth of the groove or V-shaped groove
15 V-shaped recess
16 Raised structures 1 and 2 in a recess
17 Recessed structures in a raised structure
18 Photo masking (photopolymer mask, exposed, developed and stripped)
19 Opening in the etching mask
20 Undercut (semi-circular)
21 Etching depth
22 Vertical etching without undercut
23 Second photo mask
24 Second surface structure (chemically ablative and/or galvanic deposition and/or ablative/deposition by laser)
25 Surface structure
26 Galvanic process,
27 Recessed lens structure with undercut
28 Document (ID card)
29 Lettering (such as Austria Card—recessed or raised)
30 Lens raster element, raised
31 Microprint, recessed
32 Lens raster element, recessed
33 Microprint, raised
34 Lettering, raised
35 Diffractive structure
36 Reference level (zero level) document

The invention claimed is:

1. A process to produce an embossing plate for a hot-cold-laminating press with three-dimensional structures to prepare documents by means of lamination and surface embossing, whereby recessed and raised structures relative to a highly polished surface defined as a reference level are produced in the embossing plate, wherein the recessed and raised structures are produced in at least a two-step structuring process with the first process step producing recessed and raised structures in the unstructured embossing plate surface and with the at least second step producing additional recessed and raised structures in the unstructured surface and in the previously structured surface, wherein the recessed and raised structures are produced by a galvanic process; wherein the recessed and raised structures are formed by a photomasking process; and wherein a lens shaped structure is produced and embodied as a recessed structure, and the lens shaped structure is produced by an undercut structure, the undercut structure being produced by a photomask having openings so small that there is essentially isotropic etching thereby creating a strong undercut thus achieving similar lateral etching effect as in the vertical dimension to thereby produce a desired lens shaped depression.

2. The process according to claim 1, wherein the recessed structures are produced in a single-step structuring process without damage of an uninvolved embossing plate surface.

3. The process according to claim 1, wherein the raised structures are produced in a single-step structuring process without damage of an uninvolved embossing plate surface.

4. The process according to claim 1, wherein the lens shaped structure has an optically responsive structure.

5. The process according to claim 1, wherein the unstructured surface is embodied as highly polished or satin or matt.

6. The process according to claim 1, wherein the recessed and raised structures have circular, parabolic, rectangular, V-shaped, trapezoid and/or composite shapes.

7. The process according to claim 1, wherein the recesses are produced by chemical ablation, where the form of margins is controlled by corresponding control of an undercut process.

8. The process according to claim 1, wherein the lens shaped structure is embodied as a raster or line, where raster separation is adjusted to 100 to 300 μm and the depth or height of the structures is adjusted between 2 and 150 μm.

9. The process according to claim 1, wherein the embossing plate is embodied as a non-pitted or generally flawless stainless steel plate or a steel plate with the appropriate galvanic nickel surface or a galvanically produced nickel plate, where the unstructured surface is highly polished or has a desired matt surface, and where this unstructured surface is modified only in the areas where a structure is to be added.

10. The process according to claim 1, wherein the embossing plate is embodied as a galvanized plate with a previously produced first structure for the production of additional structures.

11. The process according to claim 1, and having a diffractive structure situated on the raised structure.

12. The process according to claim 1, and having the embossing plate for a hot-cold-laminating press with three-dimensional structures on both sides of a highly-polished embossing plate surface.

13. The process according to claim 1, and using said embossing plate for a hot-cold-laminating press with a three-dimensional structure to produce security documents, such as personal identity cards, passports, identification cards, credit cards, customer cards, driving licenses and similar sheet and/or card and/or book-like documents by means of lamination and/or embossing and/or item-by-item embossing.

14. An embossing plate, which is produced in accordance with the process of claim 1.

15. The process of claim 1, and using said embossing plate in a hot-cold-laminating press, specifically a transfer press in the form of a single cycle press, a layer press or a round table and similar laminating system or in a full-area and/or individual embossing press with appropriate thermal and/or printing and/or ultrasound and/or microwave support to produce documents, specifically security documents.

16. The process of claim 1 and further producing laminated cards or identification cards and similar documents by use of said embossing plate.

17. The process according to claim 1, wherein the lens shaped structure is embodied as a raster or line, where raster separation is adjusted to 100 to 300 μm and the depth or height of the structures is adjusted between 5 and 100 μm.

* * * * *